United States Patent [19]

Luthy

[11] 4,156,750

[45] May 29, 1979

[54] METHOD FOR FABRICATING COVERING MATERIALS FROM LEATHER FOR THE UPHOLSTERY AND CUSHIONS OF FURNITURE AND COVERING MATERIALS PRODUCED BY SAID METHOD

[76] Inventor: Ernst Luthy, Blitzbergweg 836, 5313 Klingnau, Switzerland

[21] Appl. No.: 692,460

[22] Filed: Jun. 3, 1976

[30] Foreign Application Priority Data

Jun. 11, 1975 [CH] Switzerland ..... 7577/75

[51] Int. Cl.[2] ..... C14C 3/00

[52] U.S. Cl. ..... 428/151; 8/94.1 R; 8/94.15; 8/94.27; 428/15; 428/473

[58] Field of Search ..... 8/94.19, 94.15, 94.19 R, 8/94.27; 428/15, 473, 151

[56] References Cited

U.S. PATENT DOCUMENTS 34,005 12/1861 Mumma ..... 8/94.15

FOREIGN PATENT DOCUMENTS 504463 8/1930 Fed. Rep. of Germany.

OTHER PUBLICATIONS

"Leather and Hides" in Encyclopedia Britannica (15th Edition, 1973), vol. 10, pp. 759–764.

American Leathers (American Leather Producers, New York, N.Y., 1929), pp. 11–28.

"Modern Practice in Leather Manufacture" (Wilson, Reinhold Publishing Corp.) 1941, p. 664.

"Practical Leather Technology" by Thorstensen, T. C., (Krieger Publishing Co.) 1976, pp. 286, 85–101.

*Primary Examiner*—A. Lionel Clingman

*Attorney, Agent, or Firm*—Werner W. Kleeman

[57] ABSTRACT

A method of producing covering materials of leather for the upholstery and cushions of furniture, wherein the raw material or stock, if desired following evening-out by splitting, while possessing a thickness of at least 3 millimeters is converted by tanning and post-tanning into a loose-fibrous, soft and pliable condition suitable for use.

3 Claims, No Drawings

METHOD FOR FABRICATING COVERING MATERIALS FROM LEATHER FOR THE UPHOLSTERY AND CUSHIONS OF FURNITURE AND COVERING MATERIALS PRODUCED BY SAID METHOD

BACKGROUND OF THE INVENTION

The present invention relates to a new and improved method for the production of covering material formed of leather for the upholstery and cushions or the like of furniture, and this invention also pertains to covering materials fabricated according to the aforesaid method.

Leather is a naturally grown product. When it was used as a covering material for upholstery and cushions of furniture it was not only so for decades, but always so, that its natural material structure was destroyed. A primary reason for this was that previously there was exclusively employed as the covering material thin leather which was obtained by splitting, seemingly with the thought of attempting to approach the thickness of the original fabric covering, but also due to the preconception that leather must be thin in order to possess the softness and pliability required of upholstery-and cushion coverings. However, if the thickness is reduced by splitting, then there is lost the grown under-layer which has grown together with the grain side i.e., with the folds and grains, and the remaining streaks, folds and graining alter and become lost. In certain instances attempts have been made to impart to the leather by means of shrinkage tanning a "natural" appearance. However, the thus formed graining already due to its uniformity gives an artificial and by no means natural impression. There was of course generally used as covering material thin leather which was stretched by tensioning and the natural streaking or veins totally smoothed. With such material there hardly remained any of its original character when considered visually.

Equally decisive for the appearance of the finished covering material is the so-called finishing operation. With this final operation there was produced at the surface of the leather, previously while using fat and wax, later with the aid of chemicals, a protective layer in order to prevent solid or liquid contaminants from coming into contact with the surface of the covering material or penetrating into the pores thereof. Furthermore, the finishing of the leather was intended to impress thereon a certain visual effect. This however also did not produce any natural appearance and when touching the product the thus treated material likewise felt unnatural. It might also be mentioned that the foregoing opened the door completely to producing imitation leather. Indeed it is now hardly possible to distinguish between the so-to-speak de-natural coverings formed by splitting, smoothing and preparation into an actually material-foreign appearance and handle from those coverings formed of imitation leather. Furthermore, such leather coverings are particularly delicate, especially by virtue of the preparation intended for their protection, since the protective layer in the final analysis cannnot prevent the penetration, especially of liquid contaminants, into the leather and such they can become entrapped in the pores. During removal, particularly with the aid of chemical agents, also by rubbing, it is specifically the protective layer which is altered or damaged and there are formed spots or speckling which no longer can be removed.

SUMMARY OF THE INVENTION

It is a primary object of the present invention to provide a covering for upholstery and cushions of furniture and the like wherein the inherent material structure, the original graining and creasing or folds, generally the leathery appearance, but moreover also the handle or feel, remain undisturbed, furthermore, to provide a material which fulfills the highest requirements as concerns softness and pliability and additionally is less susceptible to soiling or contamination and easy to care for.

Now in order to implement these and still further objects of the invention, which will become more readily apparent as the description proceeds, the raw material or stock, if necessary following evening-out by splitting, in a thickness of at least 3 millimeters is converted by tanning and post-tanning into a loose-fibrous, soft and pliable condition suitable for use.

Limiting the production process to tanning and post-tanning, that is the omission, on the one hand, of splitting to a thickness of about 1 millimeter or below which is conventional for covering material and, on the other hand, the finishing, results in a completely novel, thick, heavy, pliable leather having a very lively streaking and graining and surprisingly is exceptionally suitable for use as coverings for upholstery and cushions. This is surprising especially because this leather differs from the conventional covering materials exactly in those features which previously were thought to be indispensable for the use here under discussion. Thus, it was completely foreign and not contemplated by those skilled in the art to use thick leather when there was demanded softness and pliability for upholstery- and cushion coverings. The concept of soft and pliable was associated with the idea that the covering had to be "thin", just as thick leather tended to be associated with the concept of rigid or stiff material. Now, however, specifically by virtue of processing thick leather into a soft and pliable covering material there is produced a previously unknown visual impression and an aesthetic effect, since the natural, namely the grown streaking and graining of the leather remains intact. Further, the thick leather notwithstanding its softness and pliability—in contrast to the thick leather obtained by splitting—is not a slack or textureless material, rather is capable of imparting a defined shape to the cushion or upholstery itself even if such has a very soft and loose filling. Additionally, the thick leather during its processing can come into play or be accentuated in a novel manner. Thus, for instance, by the formation of creases or folds there can be produced completely novel shapes and effects.

But, also the omission of the finishing must be considered as extremely unconventional. From the standpoint of the skilled artisan it is in fact not understandable to fail to provide expensive leather coverings with a protective layer. Yet is is exactly this which enables the "unprotected" surface to be able to permanently retain its appearance since upon removal of any possible contaminants there cannot be impaired or permanently altered a protective layer. Furthermore, moisture which may have possibly penetrated for instance into the pores can, in most instances, escape if there is no protective layer. Further the visual effect brought about by the omission of the protective layer is of appreciable significance. Also under this aspect the graining remains unimpaired and the leather does not have any unnatural gloss or luster. It can be distinguished visually without difficulty from finished natural leather and also from extremely good or first grade imitations thereof. There can be immediately recognized that it is a real leather covering. This can be determined even with closed eyes since the handle of the nonfinished leather—quite apart from the fact that thick material with the same softness and pliability feels different than thin material—in contrast to finished material is completely different and exceptional. Indeed the sense of feel detects the natural skin surface in contrast to a leather covering treated with a protective layer.

Due to its mentioned properties there is ascribed to the described novel, pliable, soft, yet thick covering material of leather, a comet-like commercial success. This demonstrates that in this case by deviating from the standard, indeed by overcoming the preconceptions which prevailed for many decades by those skilled in the art, it was possible to satisfy a new need.

From what has been stated it will be also seen that the inventive covering material of leather is characterized by the features that it constitutes a loose-fibrous, nonfinished grain side and under such the grown underlayer having at least 3 millimeters thickness. The thickness easily can be in the order of 3 to 6 millimeters, preferably 4 to 5 millimeters. It therefore follows that during the fabrication of such covering material it is easily possible to start with blanks or stock of 6 to 7 millimeters thickness. As a general rule there are processed bull hides or skins (cattle hides) having a green or raw weight of 50 to 100 kg. But other skins or hides of a completely different nature i.e. from any other animals can be used. What is important in each case is that the non-finished grain side is carried by the grown underlayer. The raw material is only essentially evened-out by splitting.

Described in a general way, it would be possible to carry out the production process in a manner that salted raw material (especially heavy bull hide) having a green weight of 50 to 100 kg, has the hair removed by ashing, liming or any other suitable manner, the subcutaneous connective tissue eliminated by shearing, the thickness of the hide or skin evened-out by splitting, the hide neutralized by deliming and for cleaning the grain stained with ferments. The thus fabricated tanning-out raw stock is salt-poor pickled, then the bath or liquor drained off, the still moist raw stock tanned and fatted with a basic chromium salt while using a complex former and with an electrolyte-resistant fatting agent without the addition of water. Thereafter the raw stock hung, the capillary water contained in the leather removed by withering, the thickness evened-out by folding, the raw stock washed with warm water containing a weak, volatile organic acid or a wetting agent without affinity to the hide and without tendency to precipitate with non-ionogenic, anoinic-active and cationic-active tanning auxiliary agents, post-tanned with a non-fading resin tanning agent which increases the grain strength and removes the stress from the leather and a non-fading soft-tanning vegetable tanning agent, then cold flushed, dyed with a non-fading acidic or metal complex dying agent in the presence of a non-fading weak cationic retarding agent without the addition of water, thereafter again fatted in hot water with a mixture of fatting agents possessing good internal fatting properties in the presence of an organic acid, and finally flushed.

The softening, ashing (unhairing), shearing, splitting (for evening-out) deliming and staining can be undertaken in a manner which is conventional during the fabrication of so-called Nappa leather. The softening of the raw stock preferably occurs on the reel; but it can also however be softened in a vessel or vat. If desired there can be added to the water used for softening a wetting agent. The ashing operation previously was accomplished usually with sulfides, but today predominantly sulfide-free. It is possible, for instance, with pancreas staining to clean the grain.

During pickling, i.e., during acidification of the raw stock, it is necessary when using sulfuric acid to add relatively large quantities fof mineral salt (water:salt approximately 10:1) in order to prevent an undesired swelling of the raw stock. It is preferable however to carry out the pickling operation such that it is poor or low in salt. For this purpose there are suitable organic acids, especially aromatic sulfonic acids, such as sulfosalicylic acid, sulfoanthranilic acid and sulfophthalic acid as well as mixtures thereof. It is then possible to use a water-salt ratio of about 40:1. As the salt there can particularly be used sodium chloride. The addition of sodium formiate is advantageous.

The chrome tanning and fatting are advantageously simultaneously carried out and without bath, i.e., only with the moisture contained in the raw stock. As a basic chromium salt there particularly comes into consideration basic chromium sulfate, for instance one which contains 33% basic chromium sulfate (corresponding to 25% to 26% $Cr_2O_3$). As the complex former (masking agent) for the chromium salt there can be used, for instance, aromatic and aliphatic dicarboxylic acids, such as oxalic acid and phthalic acid or mixtures thereof. If the employed basic chromium salt is not self-dulling, then for the dulling or delustering operation it is possible to add at the end of tanning and fatting, for instance sodium bicarbonate. The fatting agent must be of course electrolyte-resistant. For this purpose there are suitable sulfurized oils, for instance fat-liquor on the basis of sulfurized sperm oil and sulfurized fish oil.

After the hanging, withering and folding operations the leather is flushed with warm water (for instance approximately at 35° C.), which contains either a weak, volatile organic acid, especially acetic acid or preferably a wetting agent without affinity to the hide and without any tendency to precipitate with non-ionogenic, anoinic-active and cationic-active tanning auxiliary agents, for instance a fatty acid-polyethyleneglycolester-sulfate.

During the post-tanning there is developed the streaking and graining of the leather. For this purpose there is employed non-fading resin tanning substances which increase the grain strength and remove the stress from the leather, for instance phenol-formaldehyde-condensation products, condensation products of urea, formaldehyde and aromatic tanning sulfonic acids or condensation products of dicyandiamide, formaldehyde and organic sulfonic acids or urea. For the neutralization of free acids there is advantageous the addition of alkaline salts, such as sodium formiate and sodium bicarbonate.

The dyeing advantageously is likewise carried out without any bath, and specifically with through-dyeing, non-fading acidic or metal complex dyes, such as "DERMA-LICHT" or "SANDOLAN"-dyes (Sandoz Company, Switzerland), "ISOLAN"-dyes (Bayer) and "ERGANIL"-dyes (BASF), in the presence of non-fading, weak cationic retarding agents, such as "DERMAGEN PR".

Following dyeing there is again carried out a fatting operation in hot water, for instance at approximately 60° C., with a mixture of fatting agents having good internal fatting properties, for instance on the basis of sulfurized, preferably weak sulfurized and fat-containing oil, such as wheat oil or fish oil in the presence of an organic acid, preferably formic acid. As is well known the acid serves for the fixation of the dye.

The above disclosure of course is only representative in nature and in no way limiting, as is also the following example given by way of illustration.

EXAMPLE

Salted heavy bull hides having a green weight of 50 to 100 kg were softened, unhaired for instance by ashening, sheared, evened-out by splitting, delimed and stained, in a manner conventional during the production of Nappa leather. Hereinafter there is given percentage data related to the raw stock weight.

70% water at 20° C. and 2% sodium chloride are placed into a vat, mixed for 5 minutes, the raw stock added and there is permitted to run through the hollow ash 2.5% of a mixture of aromatic sulfonic acid and 0.5% sodium formiate into the vat, whereafter mixing is carried out for three hours. The raw stock is left overnight in the quiet vat. In the morning, if desired, the contents of the vat can be moved for a further 5 minutes and then the vat is drained off.

Now there is added 5 to 12% of a tanning-finishing chromium salt mixture for the single-bath chrome tanning, which contains 33% basic chromium (III) sulfate (corresponding to 25 to 26% $Cr_2O_3$), and 1 to 5% of a mixture of an electrolyte-resistant fatting agent on the basis of sulfurized sperm oil or sulfurized fish oil and the batch mixed for 60 minutes. Thereafter there is added approximately 1.5% of a powdery mixture of complex-forming aromatic and aliphatic dicarboxylic acids and again mixed for 60 minutes. Finally, there is added about 0.5% sodium bicarbonate and again mixed for 60 minutes.

After the tanning and fatting the raw stock is hung-up, usually overnight, and then withered and folded. The percentage data in the following disclosure relate to the fold weight.

The raw stock or skins in the vat are treated with 100% water at 35° C. and 0.1% to 2% of a 60% solution of fatty acid polyethyleneglycolester sulfate, mixing being accomplished for 30 minutes. Then the bath is drained off.

Now there is added 100% water at 35° C. and 1% sodium formiate and mixing occurs for 10 minutes. Thereafter there is added 3% sodium bicarbonate and mixing again carried out for 2.5 hours. Finally, there is added 2% to 7% of a non-fading resin tanning agent (phenol-formaldehyde-condensation product) and 1% to 7% of a vegetable tanning agent and admixed for 60 minutes. Following the post-tanning cold flushing is carried out.

The dyeing occurs again without bath with a non-fading acidic or metal complex dye and 1% of a weak cationic, non-fading retarding agent, with there being carried out mixing for 2.5 hours. Then there is added 300% water at 60° C., 2% to 10% of a mixture of a fatting agent on the basis of sulfurized fish oil, a weak sulfurized, fat-containing secal oil and an anoinic-active fatting agent which emulsifies in water and formed on the basis of fish oil, mixing being carried out for 60 minutes. Finally, there is added 2% formic acid and mixed for 20 minutes. Flushing follows the fixation of the dye.

There is obtained a 3 to 6 millimeter thick, heavy, pliable leather with a very lively streaking or graining, which is through-dyed and suitable for working into coverings for upholstery and cushions of furniture.

Generally, it is further to be mentioned that the tanner previously never was confronted with the task of converting thick leather by tanning and post-tanning into a soft, pliable condition and thus also accordingly already forming a new material. Hence, there is no doubt that the given knowledge in the art must have been adequate to solve the aforementioned task if the problem once was presented. In any event—and this holds true as a historical fact—the person skilled in the art was never on his own confronted with the unusual task of fabricating soft pliable covering material for upholstery and cushions in the form of horrendously (as far as the skilled artisan was concerned) thick leather and to limit the production process essentially to tanning and post-tanning. What is meant is omitting the finishing operation since the dyeing—just mentioning this example—is not part of the actual tanning process. The same holds true for the impregnation. It should be understood that this operation also can be advantageously employed in the present case. In so doing, however, the fibers are merely enclosed by the impregnation material and—other than during finishing—the grain side or surface does not contain any protective agent. The natural handle i.e., the lively feel, thus remains completely intact also for impregnated leather.

While there are described preferred embodiments of the invention, it is to be distinctly understood that the invention is not limited thereto, but may be otherwise variously embodied and practiced within the scope of the following claims. Accordingly,

What is claimed is:

1. Leather for use in fabricating covering material for upholstery and cushions of furniture, the leather comprising a loose-fibrous exposed hairless grain side devoid of any protective finish and, below the grain side, a thick underlayer of at least 3 millimeters thickness.

2. Leather produced according to claim 1, wherein the leather has a total thickness of 3 to 6 millimeters.

3. Leather according to claim 2, wherein the total thickness of the leather is between 4 to 5 millimeters.

* * * * *